US011472180B2

(12) United States Patent
Fuller et al.

(10) Patent No.: US 11,472,180 B2
(45) Date of Patent: Oct. 18, 2022

(54) FLUID EJECTION DEVICES INCLUDING ELECTRICAL INTERCONNECT ELEMENTS FOR FLUID EJECTION DIES

(71) Applicant: HEWLETT-PACKARD DEVELOPMENT COMPANY, L.P., Spring, TX (US)

(72) Inventors: Anthony M. Fuller, Corvallis, OR (US); Daren L. Forrest, Corvallis, OR (US); Michael W. Cumbie, Corvallis, OR (US); Michael Groom, Corvallis, OR (US); Conrad Jenssen, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/769,921

(22) PCT Filed: Feb. 6, 2019

(86) PCT No.: PCT/US2019/016857
§ 371 (c)(1),
(2) Date: Jun. 4, 2020

(87) PCT Pub. No.: WO2020/162928
PCT Pub. Date: Aug. 13, 2020

(65) Prior Publication Data

US 2021/0260872 A1 Aug. 26, 2021

(51) Int. Cl.
*B41J 2/14* (2006.01)
*B41J 2/145* (2006.01)

(52) U.S. Cl.
CPC ..... *B41J 2/14* (2013.01); *B41J 2/145* (2013.01); *B41J 2002/14491* (2013.01); *B41J 2202/20* (2013.01)

(58) Field of Classification Search
CPC .... B41J 2/14; B41J 2/145; B41J 2002/14491; B41J 2/14072; B41J 2202/20
See application file for complete search history.

(56) References Cited

U.S. PATENT DOCUMENTS

| | | | | |
|---|---|---|---|---|
| 4,635,073 | A | 1/1987 | Hanson | |
| 6,290,333 | B1 | 9/2001 | Wade et al. | |
| 6,536,871 | B1 | 3/2003 | Haddick et al. | |
| 6,808,249 | B1 * | 10/2004 | Kneezel | B41J 2/2103 347/42 |
| 8,444,255 | B2 | 5/2013 | Bakker et al. | |
| 9,770,909 | B2 | 9/2017 | Chen et al. | |

(Continued)

FOREIGN PATENT DOCUMENTS

| | | |
|---|---|---|
| CN | 101479110 A | 7/2009 |
| CN | 102470671 A | 5/2012 |

(Continued)

*Primary Examiner* — Jason S Uhlenhake
(74) *Attorney, Agent, or Firm* — Dicke Billig & Czaja PLLC

(57) ABSTRACT

A device includes a plurality of fluid ejection dies, wherein each of the fluid ejection dies includes a contact pad and a plurality of fluid actuation devices. The device includes an electrical interconnect element in contact with the contact pad of each of the fluid ejection dies to electrically interconnect the plurality of fluid ejection dies.

21 Claims, 8 Drawing Sheets

(56) References Cited

U.S. PATENT DOCUMENTS

| | | | | |
|---|---|---|---|---|
| 2002/0089567 | A1* | 7/2002 | Sato | B41J 2/1623 347/50 |
| 2004/0087063 | A1 | 5/2004 | Akhavin et al. | |
| 2008/0211883 | A1* | 9/2008 | Yamashita | B41J 2/1632 347/72 |
| 2013/0050344 | A1* | 2/2013 | Rice | B41J 2/17526 347/50 |
| 2013/0193105 | A1 | 8/2013 | Ciminelli | |
| 2015/0070438 | A1* | 3/2015 | Yabe | B41J 2/14072 347/50 |
| 2017/0120596 | A1 | 5/2017 | Chen et al. | |
| 2017/0355185 | A1 | 12/2017 | Anderson et al. | |
| 2018/0154632 | A1 | 6/2018 | Chen et al. | |
| 2018/0201017 | A1 | 7/2018 | Lutnesky | |
| 2018/0333956 | A1 | 11/2018 | Chen | |
| 2019/0001676 | A1 | 1/2019 | Chen | |

FOREIGN PATENT DOCUMENTS

| | | | |
|---|---|---|---|
| CN | 106660366 | A | 5/2017 |
| EP | 1172217 | A2 | 1/2002 |
| EP | 1186417 | | 1/2006 |
| WO | 2014/133600 | A1 | 9/2014 |
| WO | WO2016032497 | | 3/2016 |

* cited by examiner

FLUID EJECTION DEVICES INCLUDING ELECTRICAL INTERCONNECT ELEMENTS FOR FLUID EJECTION DIES

CROSS-REFERENCE TO RELATED APPLICATIONS

This application is a U.S. National Stage Application of PCT Application No. PCT/US2019/016857, filed Feb. 6, 2019, entitled "FLUID EJECTION DEVICES INCLUDING ELECTRICAL INTERCONNECT ELEMENTS FOR FLUID EJECTION DIES."

BACKGROUND

An inkjet printing system, as one example of a fluid ejection system, may include a printhead, an ink supply which supplies liquid ink to the printhead, and an electronic controller which controls the printhead. The printhead, as one example of a fluid ejection device, ejects drops of ink through a plurality of nozzles or orifices and toward a print medium, such as a sheet of paper, so as to print onto the print medium. In some examples, the orifices are arranged in at least one column or array such that properly sequenced ejection of ink from the orifices causes characters or other images to be printed upon the print medium as the printhead and the print medium are moved relative to each other.

DETAILED DESCRIPTION

In the following detailed description, reference is made to the accompanying drawings which form a part hereof, and in which is shown by way of illustration specific examples in which the disclosure may be practiced. It is to be understood that other examples may be utilized and structural or logical changes may be made without departing from the scope of the present disclosure. The following detailed description, therefore, is not to be taken in a limiting sense, and the scope of the present disclosure is defined by the appended claims. It is to be understood that features of the various examples described herein may be combined, in part or whole, with each other, unless specifically noted otherwise.

In certain examples, it may be desirable to reduce the width of a semiconductor die or device including fluid actuation devices (e.g., a fluid ejection die) to reduce costs and improve manufacturability. In one example, a device is provided with a contact pad arrangement that enables such relatively narrow die. Accordingly, described herein is a device to enable fluid ejection, including contact pads arranged longitudinally with respect to the device. A first column of six contact pads may be arranged at one end of the device and a second column of six contact pads may be arranged at the other end of the device and aligned with the first column of contact pads. A column of fluid actuation devices may be arranged between the first column of contact pads and the second column of contact pads.

Some examples of the present disclosure are directed to a fluid ejection device that includes multiple fluid ejection dies within an epoxy over-molded package. Each die includes a column of contact pads. The device includes a flex circuit having a plurality of beams that span across the individual dies in an open die window. Each beam is connected to one of the contact pads of each of the individual dies, thereby electrically connecting together the multiple dies. Flex circuit interconnect (FCI) ganged thermal compression tape-automated bonding (tab) may be used to bond the beams to the contact pads of the multiple dies. This method enables ganged tab bonding to interconnect multiple dies in a single step.

Figure 1A:
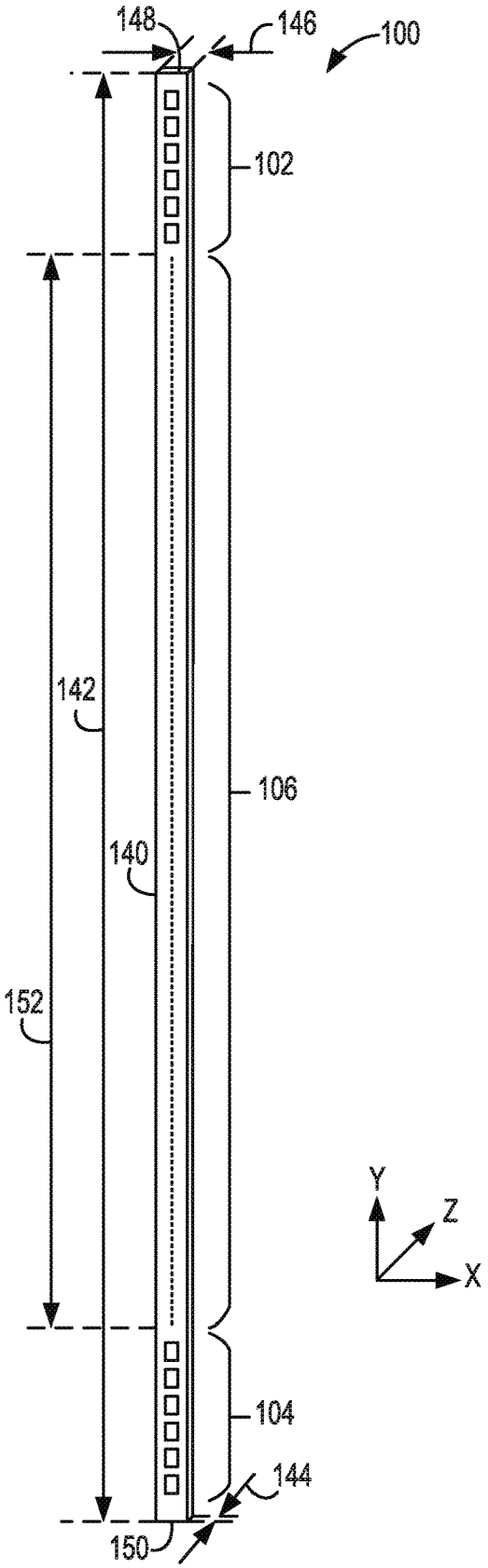
FIGS. 1A and 1B illustrate one example of a fluid ejection die.
Figure 1B:
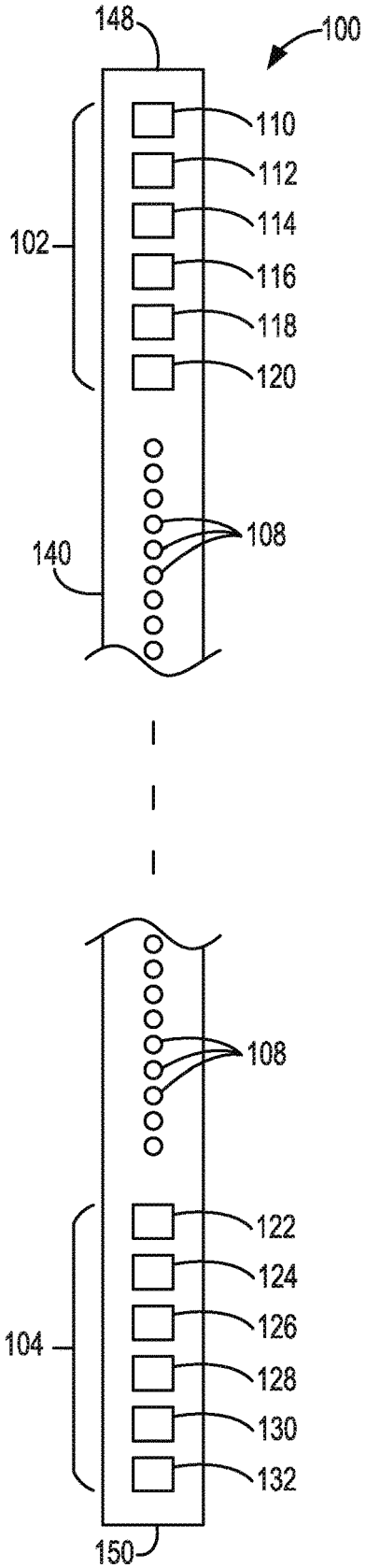

FIG. 1A illustrates one example of a fluid ejection die 100 and FIG. 1B illustrates an enlarged view of the ends of fluid ejection die 100. Die 100 includes a first column 102 of contact pads, a second column 104 of contact pads, and a column 106 of fluid actuation devices 108. The second column 104 of contact pads is aligned with the first column 102 of contact pads and at a distance (i.e., along the Y axis) from the first column 102 of contact pads. The column 106 of fluid actuation devices 108 is disposed longitudinally to the first column 102 of contact pads and the second column 104 of contact pads. The column 106 of fluid actuation devices 108 is also arranged between the first column 102 of contact pads and the second column 104 of contact pads. In one example, fluid actuation devices 108 are nozzles or fluidic pumps to eject fluid drops.

In one example, the first column 102 of contact pads includes six contact pads. The first column 102 of contact pads may include the following contact pads in order: a data contact pad 110, a clock contact pad 112, a logic power ground return contact pad 114, a multipurpose input/output contact pad 116, a first high voltage power supply contact pad 118, and a first high voltage power ground return contact pad 120. Therefore, the first column 102 of contact pads includes the data contact pad 110 at the top of the first column 102, the first high voltage power ground return contact pad 120 at the bottom of the first column 102, and the first high voltage power supply contact pad 118 directly above the first high voltage power ground return contact pad 120. While contact pads 110, 112, 114, 116, 118, and 120 are illustrated in a particular order, in other examples the contact pads may be arranged in a different order.

In one example, the second column 104 of contact pads includes six contact pads. The second column 104 of contact pads may include the following contact pads in order: a second high voltage power ground return contact pad 122, a second high voltage power supply contact pad 124, a logic reset contact pad 126, a logic power supply contact pad 128, a mode contact pad 130, and a fire contact pad 132. Therefore, the second column 104 of contact pads includes the second high voltage power ground return contact pad 122 at the top of the second column 104, the second high voltage power supply contact pad 124 directly below the second high voltage power ground return contact pad 122, and the fire contact pad 132 at the bottom of the second column 104. While contact pads 122, 124, 126,128, 130, and 132 are illustrated in a particular order, in other examples the contact pads may be arranged in a different order.

Data contact pad 110 may be used to input serial data to die 100 for selecting fluid actuation devices, memory bits, thermal sensors, configuration modes, etc. Data contact pad 110 may also be used to output serial data from die 100 for reading memory bits, configuration modes, etc. Clock contact pad 112 may be used to input a clock signal to die 100 to shift serial data on data contact pad 110 into the die or to shift serial data out of the die to data contact pad 110. Logic power ground return contact pad 114 provides a ground return path for logic power (e.g., about 0 V) supplied to die 100. In one example, logic power ground return contact pad 114 is electrically coupled to the semiconductor (e.g., silicon) substrate 140 of die 100. Multipurpose input/output contact pad 116 may be used for analog sensing and/or digital test modes of die 100.

First high voltage power supply contact pad 118 and second high voltage power supply contact pad 124 may be used to supply high voltage (e.g., about 32 V) to die 100. First high voltage power ground return contact pad 120 and second high voltage power ground return contact pad 122 may be used to provide a power ground return (e.g., about 0 V) for the high voltage power supply. The high voltage power ground return contact pads 120 and 122 are not directly electrically connected to the semiconductor substrate 140 of die 100. The specific contact pad order with the high voltage power supply contact pads 118 and 124 and the high voltage power ground return contact pads 120 and 122 as the innermost contact pads may improve power delivery to die 100.

Logic reset contact pad 126 may be used as a logic reset input to control the operating state of die 100. Logic power supply contact pad 128 may be used to supply logic power (e.g., between about 1.8 V and 15 V, such as 5.6 V) to die 100. Mode contact pad 130 may be used as a logic input to control access to enable/disable configuration modes (i.e., functional modes) of die 100. Fire contact pad 132 may be used as a logic input to latch loaded data from data contact pad 110 and to enable fluid actuation devices or memory elements of die 100.

Die 100 includes an elongate substrate 140 having a length 142 (along the Y axis), a thickness 144 (along the Z axis), and a width 146 (along the X axis). In one example, the length 142 is at least twenty times the width 146. The width 146 may be 1 mm or less and the thickness 144 may be less than 500 microns. The fluid actuation devices 108 (e.g., fluid actuation logic) and contact pads 110-132 are provided on the elongate substrate 140 and are arranged along the length 142 of the elongate substrate. Fluid actuation devices 108 have a swath length 152 less than the length 142 of the elongate substrate 140. In one example, the swath length 152 is at least 1.2 cm. The contact pads 110-132 may be electrically coupled to the fluid actuation logic. The first column 102 of contact pads may be arranged near a first longitudinal end 148 of the elongate substrate 140. The second column 104 of contact pads may be arranged near a second longitudinal end 150 of the elongate substrate 140 opposite to the first longitudinal end 148.

Figure 2:
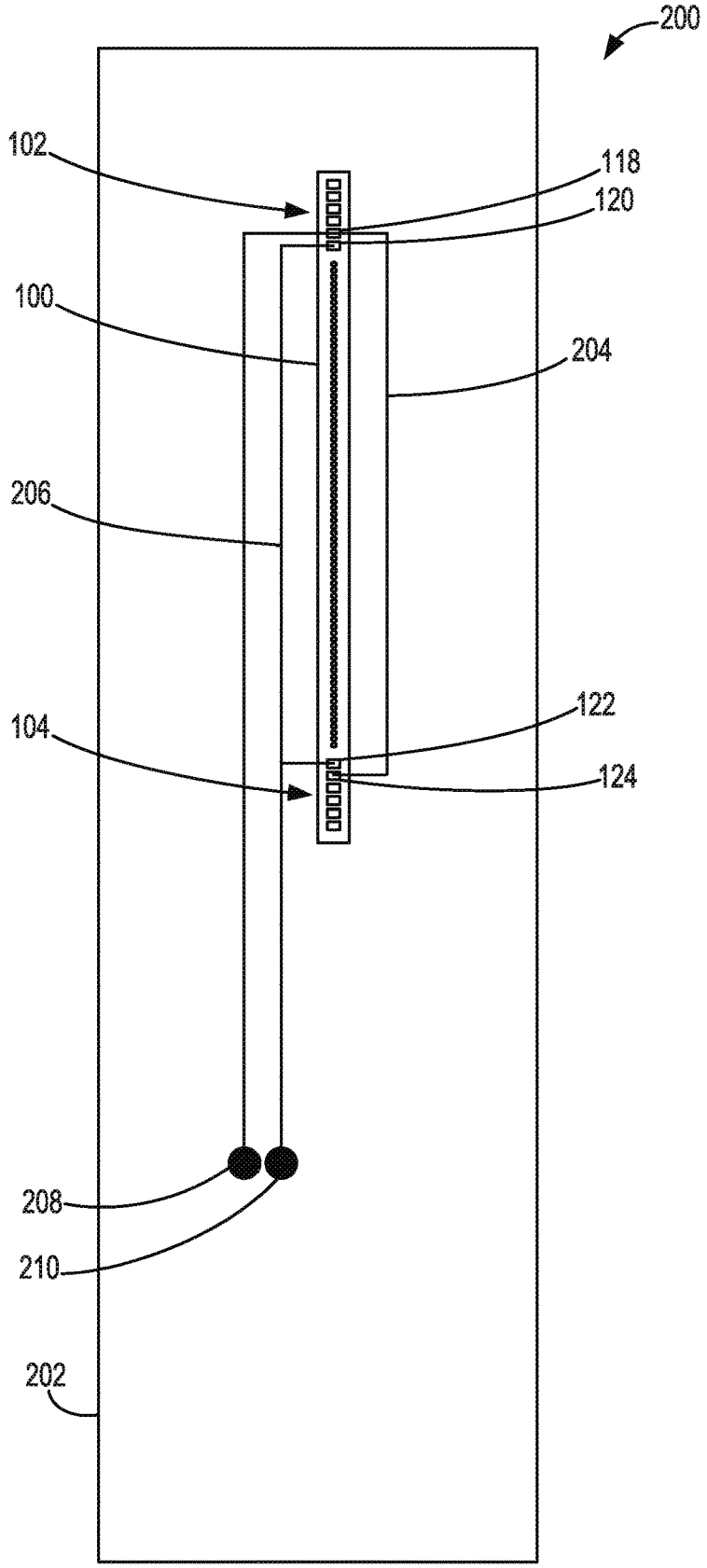
FIG. 2 illustrates one example of a portion of a fluid ejection device.

FIG. 2 illustrates one example of a portion of a fluid ejection device 200. In one example, fluid ejection device 200 is a printhead assembly for ejecting fluid of a single color (e.g., black). Fluid ejection device 200 includes a carrier 202 and a fluid ejection die 100. As previously described and illustrated with reference to FIGS. 1A and 1B, fluid ejection die 100 includes a plurality of first contact pads arranged in a first column 102 and a plurality of second contact pads arranged in a second column 104 aligned with the first column 102. Fluid ejection die 100 may be embedded in or adhered to carrier 202. In one example, carrier 202 is a flex circuit (also known as a Tape Automated Bonding, or "TAB", assembly).

Carrier 202 may include a first conductive line 204 electrically coupling a first contact pad (e.g., first high voltage power supply contact pad 118) to a second contact pad (e.g., second high voltage power supply contact pad 124). Carrier 202 may also include a second conductive line 206 electrically coupling a first contact pad (e.g., first high voltage power ground return contact pad 120) to a second contact pad (e.g., second high voltage power ground return contact pad 122).

The first conductive line 204 may be electrically coupled to a first electrical interconnect pad 208, and the second conductive line 206 may be electrically coupled to a second electrical interconnect pad 210. Electrical interconnect pads 208 and 210 may be used to electrically couple fluid ejection device 200 to a fluid ejection system, such as a printer. The electrical interconnect pads 208 and 210 may be used to supply high voltage power from a fluid ejection system to fluid ejection die 100. Additional conductive lines and additional electrical interconnect pads (not shown) may be electrically coupled to the other contact pads of first column 102 and second column 104 to provide electrical connections between fluid ejection die 100 and a fluid ejection system.

Figure 3:
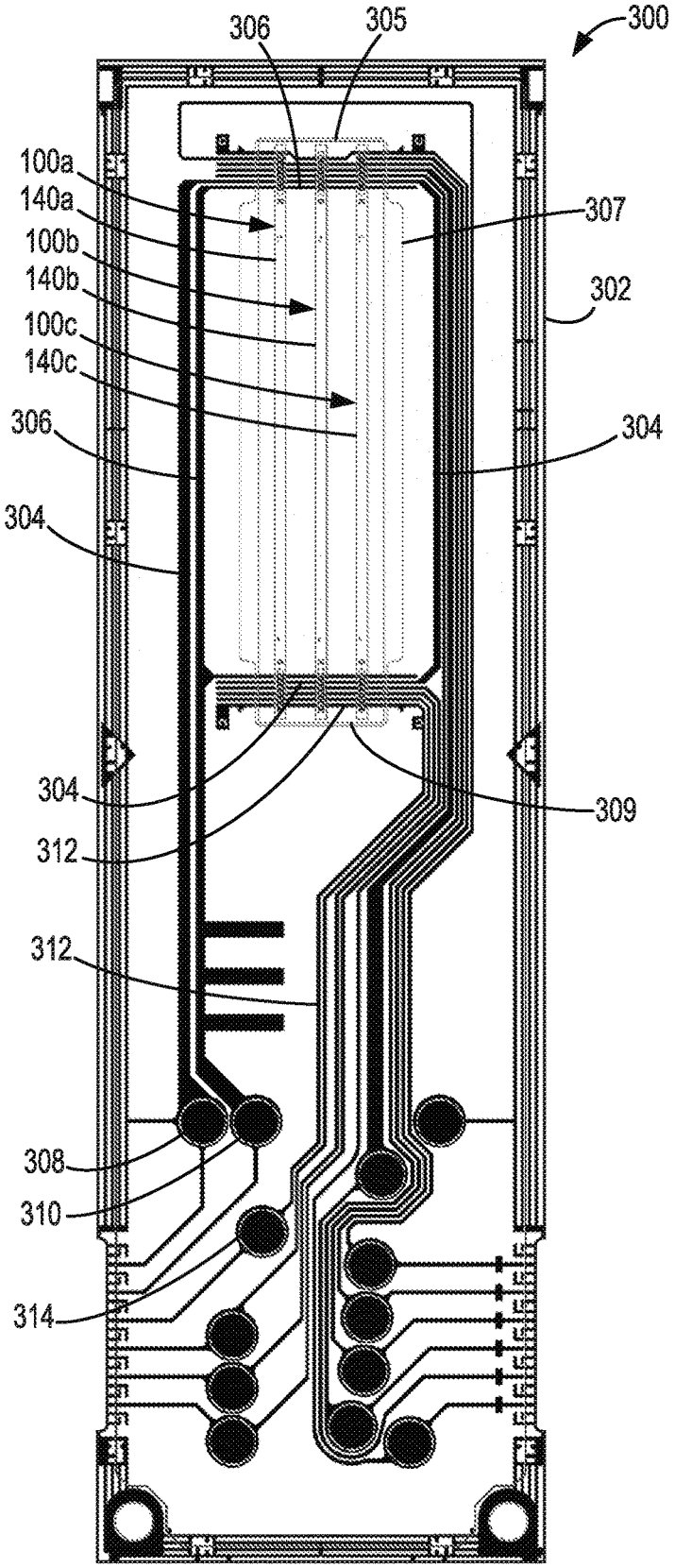
FIG. 3 illustrates another example of a fluid ejection device.

FIG. 3 illustrates another example of a fluid ejection device 300. In one example, fluid ejection device 300 is a printhead assembly for ejecting fluid of three different colors (e.g., cyan, magenta, and yellow). Fluid ejection device 300 includes a carrier 302 and a plurality of fluid ejection dies 100*a*-100*c*. The plurality of fluid ejection dies 100*a*-100*c* are packaged in a substrate 307, which includes a top end 305 and a bottom end 309. As previously described and illustrated with reference to FIGS. 1A and 1B, each fluid ejection die 100*a*-100*c* includes an elongate substrate 140*a*-140*c*, respectively. The plurality of elongate substrates 140*a*-140*c* are arranged parallel to each other on the carrier 302. Each of the plurality of elongate substrates 140*a*-140*c* may include a single color substrate and each single color substrate may be of a different color. Elongate substrates 140*a*-140*c* may be embedded in or adhered to carrier 302. In one example, carrier 302 is a flex circuit (also known as a Tape Automated Bonding, or "TAB", assembly).

Carrier 302 includes electrical routing (e.g. conductive lines 304, 306, and 312 described below) to electrical interconnect pads (e.g., electrical interconnect pads 308, 310, and 314 described below) to connect a fluid ejection system circuit (e.g., a printer circuit) to the contact pads of the elongate substrates 140*a*-140*c*. In one example, the electrical routing may be arranged between the elongate substrates 140*a*-140*c*.

Carrier 302 may include at least one electrical interconnect element. The electrical interconnect element may include a first conductive line 304 electrically coupling a first contact pad of each elongate substrate 140*a*-140*c* (e.g., the first high voltage power supply contact pad 118 of each elongate substrate 140*a*-140*c*) to a second contact pad of each elongate substrate 140*a*-140*c* (e.g., the second high voltage power supply contact pad 124 of each elongate substrate 140*a*-140*c*). The carrier 302 may further include a second and third electrical interconnect element, for example, including a second and third conductive line 306, 312, respectively. For example, the carrier 302 includes a second conductive line 306 electrically coupling a first contact pad of each elongate substrate 140*a*-140*c* (e.g., first high voltage power ground return contact pad 120 of each elongate substrate 140*a*-140*c*) to a second contact pad of each elongate substrate 140*a*-140*c* (e.g., second high voltage power ground return contact pad 122 of each elongate substrate 140*a*-140*c*). In further examples, the electrical interconnect elements may include or be supported by relatively rigid carrier portions, more rigid than the flex.

The first conductive line 304 may be electrically coupled to a first electrical interconnect pad 308, and the second conductive line 306 may be electrically coupled to a second electrical interconnect pad 310. Electrical interconnect pads 308 and 310 may be used to electrically couple fluid ejection device 300 to a host controller of a host fluid ejection system, such as a printer. The electrical interconnect pads 308 and 310 may be used to supply high voltage power from a fluid ejection system to elongate substrates 140*a*-140*c*. Additional conductive lines and additional electrical interconnect pads (e.g. conductive line 312 and electrical interconnect pad 314) may be electrically coupled to the other contact pads of elongate substrates 140*a*-140*c* to provide electrical connections between elongate substrates 140*a*-140*c* and a fluid ejection system. The orientation of the contact pads of elongate substrates 140*a*-140*c* enables the multiple dies to be bonded in parallel with fewer flex wires and connections.

Figure 4:
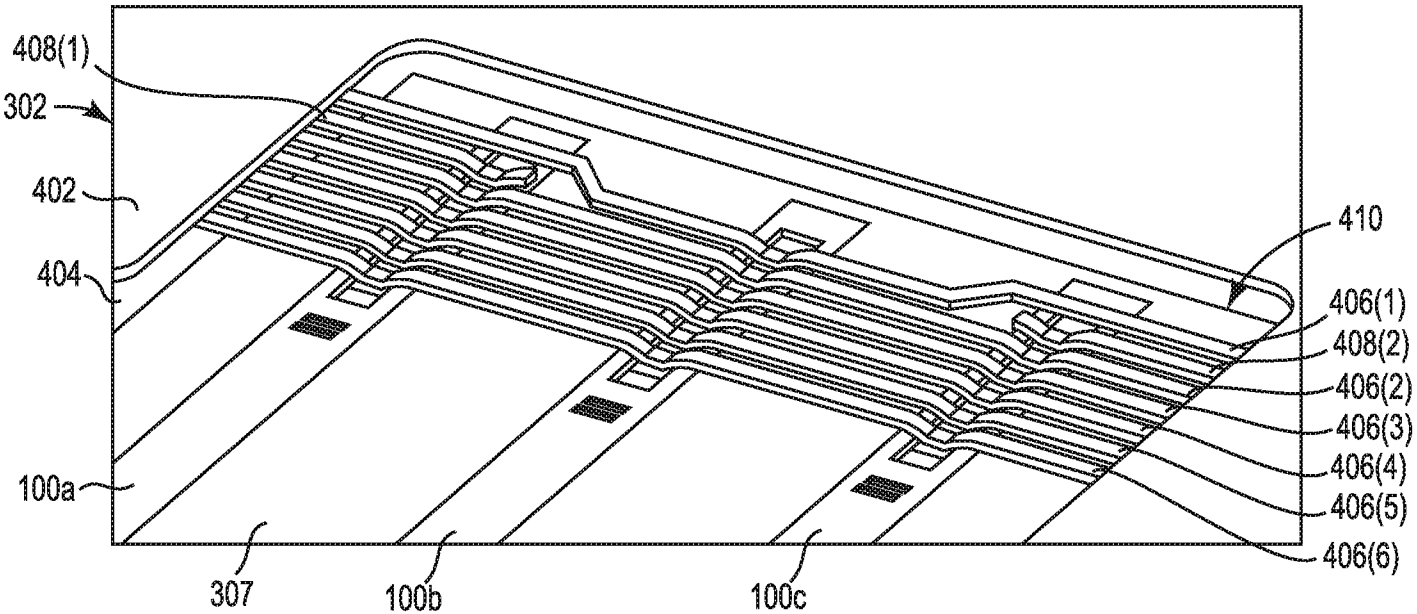
FIG. 4 is a diagram illustrating a perspective view of conductive lines near the top end of the substrate shown in FIG. 3 according to one example.

FIG. 4 is a diagram illustrating a perspective view of conductive lines near the top end 305 of the substrate 307 shown in FIG. 3 according to one example. As shown in FIG. 4, an open window 410 is formed in the carrier 302, and the plurality of fluid ejection dies 100*a*-100*c* are positioned within the open window 410 such that an entire top surface of each of the dies 100*a*-100*c* is exposed (i.e., not covered by the carrier 302). The carrier 302 may include a top layer 402 and a bottom layer 404. The outer edges of the substrate 307 are attached to a bottom surface of the bottom layer 404. The electrical interconnect elements may be relatively rigid. For example, the electrical interconnect elements may include, and/or be supported by, respective beam portions 406 and 408.

In the example of the drawings, the conductive lines 304, 306 of the carrier 302 include beam portions 406(1)-406(6) (collectively referred to as beam portions 406), and beam portions 408(1)-408(2) (collectively referred to as beam portions 408). Each of the beam portions 406 extends horizontally across an entire width of the open window 410 formed in the carrier 302, and is perpendicular or substantially perpendicular to the fluid ejection dies 100*a*-100*c* and the column of contact pads and fluid actuation devices in the dies 100*a*-100*c*. Each of the beam portions 408 extends horizontally across a portion of the open window 410. Beam portions 406 and 408 are exposed (i.e., not covered by the substrate 307, while the remaining portions of the conductive lines that include the beam portions 406 and 408 are positioned between the top layer 402 and the bottom layer 404 of the carrier 302, and are, therefore, not exposed. Beam portions 406 and 408 extend straight across the open window 410, with the exception of beam portion 406(1), which includes a first bent portion between dies 100*a* and 100*b* and a second bent portion between dies 100*b* and 100*c*.

Beam portion 406(1) is electrically connected to the data contact pad 110 of fluid ejection die 100*b*. Beam portion 408(1) is electrically connected to the data contact pad 110 of fluid ejection die 100*a*. Beam portion 408(2) is electrically connected to the data contact pad 110 of fluid ejection die 100*c*. The three beam portions 406(1), 408(1) and 408(2) allow the three data contact pads 110 to be individually addressed.

Beam portion 406(2) is electrically connected to contact pad 112 of each of the fluid ejection dies 100*a*-100*c*. Beam portion 406(3) is electrically connected to contact pad 114 of each of the fluid ejection dies 100*a*-100*c*. Beam portion 406(4) is electrically connected to contact pad 116 of each of the fluid ejection dies 100*a*-100*c*. Beam portion 406(5) is electrically connected to contact pad 118 of each of the fluid ejection dies 100*a*-100*c*. Beam portion 406(6) is electrically connected to contact pad 120 of each of the fluid ejection dies 100*a*-100*c*.

The conductive lines near the bottom end 309 of the substrate 307 shown in FIG. 3 may also include beam portions that are configured in the same manner as beam portions 406 and 408. Also, the beam portions 406 and 408 may be used to interconnect more or less than three fluid ejection dies, and may be used to connect to a single fluid ejection die, such as fluid ejection die 100 in fluid ejection device 200 (FIG. 2).

Figure 5:
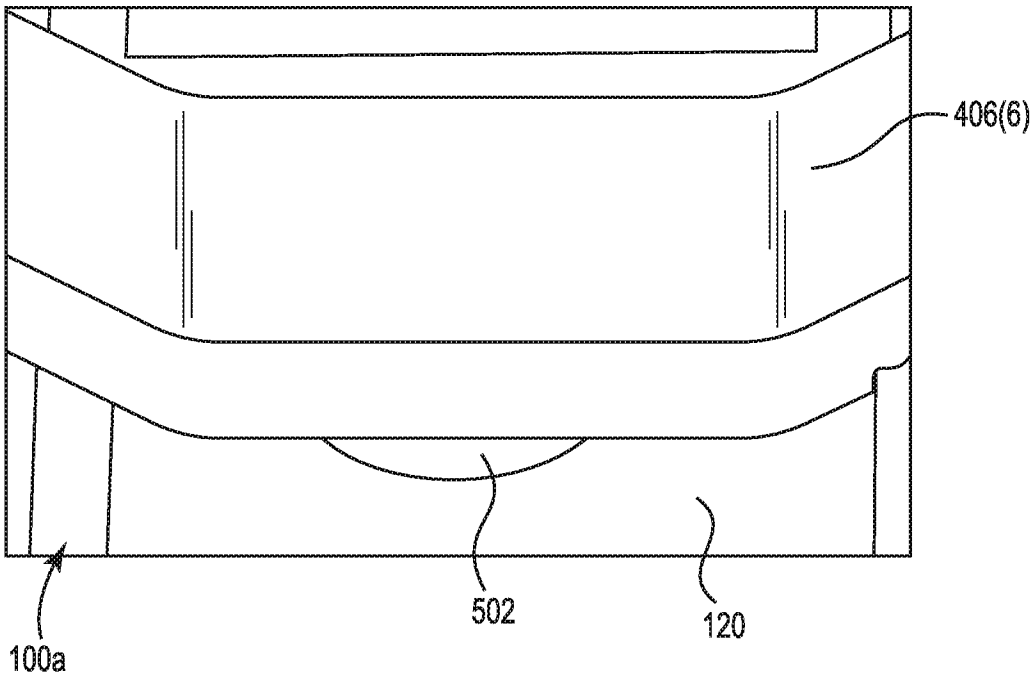
FIG. 5 is a diagram illustrating a close-up view of one of the beam portions bonded to a one of the contact pads of a fluid ejection die according to one example.

In one example, the beam portions 406 and 408 are bonded to the contact pads of the fluid ejection dies 100*a*-100*c* using a flex circuit interconnect (FCI) gang thermal compression tab bond process. This process combines die attach and electrical interconnect to the carrier 302 at the same time, and allows all of the bonds to be accomplished in a single process step. FIG. 5 is a diagram illustrating a close-up view of one of the beam portions 406 (e.g., beam portion 406(6) bonded to a one of the contact pads of a fluid ejection die (e.g., contact pad 120 of fluid ejection die 100*a*) according to one example. The bonding process results in the beam portion 406(6) being compressed and bent downward towards the contact pad 120, and the beam portion 406(6) is bonded to a stud bump 502 on the contact pad 120.

Figure 6:
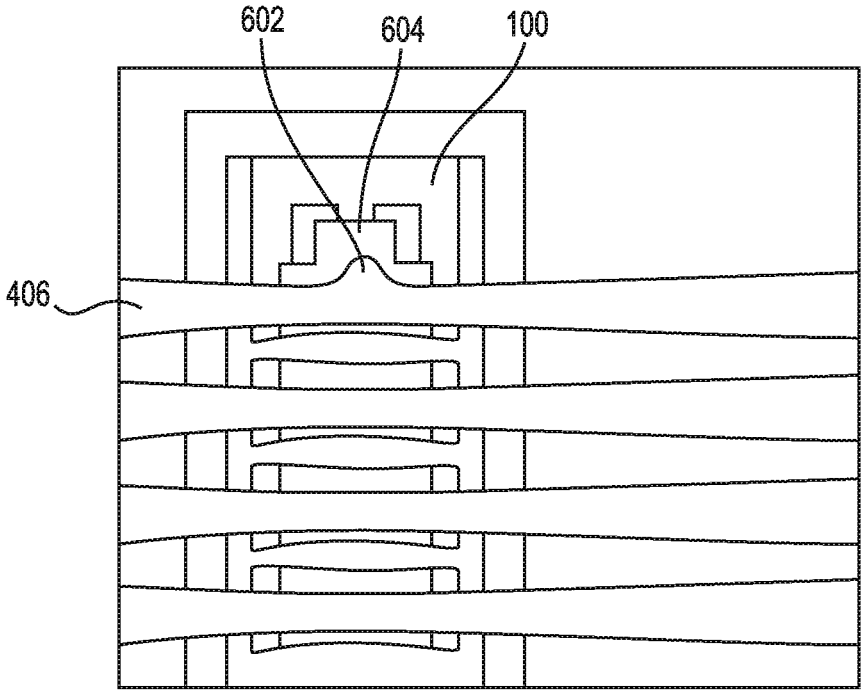
FIG. 6 is a diagram illustrating a beam portion with a targeting fiducial according to one example.

Any of the beam portions 406 or 408 may include a targeting fiducial to facilitate alignment of the beam portions with the contact pads of the fluid ejection dies 100*a*-100*c*. FIG. 6 is a diagram illustrating a beam portion 406 with a targeting fiducial 602 according to one example. As shown in FIG. 6, the targeting fiducial 602 is aligned with a target 604 formed near a contact pad on the fluid ejection die 100.

Figure 7:
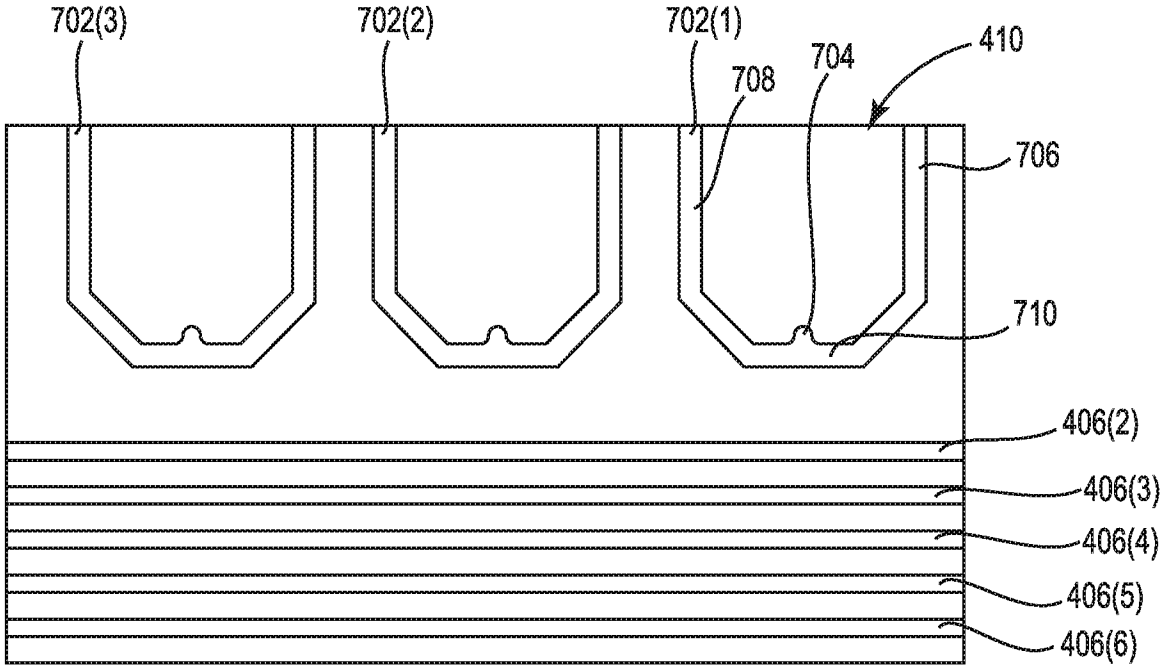
FIG. 7 is a diagram illustrating a perspective view of conductive lines near the top end of the substrate shown in FIG. 3 according to another example.

FIG. 7 is a diagram illustrating a perspective view of conductive lines near the top end 305 of the substrate 307 shown in FIG. 3 according to another example. The example shown in FIG. 7 is the same as the example shown in FIG. 4, with the exception that the beam portions 406(1), 408(1), and 408(2) in FIG. 4 have been replaced by u-shaped conductors 702(1), 702(2), and 702(3) (collectively referred to as u-shaped conductors 702) in FIG. 7. Each of the u-shaped conductors 702 includes two vertical portions 706 and 708 that extend downward from the top of the die window 410, and a horizontal portion 710 that extends horizontally across a portion of the die window 410 and is electrically connected to one of the data contact pads 110 of one of the fluid ejection dies 100*a*-100*c*. The three u-shaped conductors 702 allow the three data contact pads 110 to be individually addressed. The horizontal portion 710 of at least one of the u-shaped conductors 702 may include a targeting fiducial 704 to facilitate alignment with the contact pads of the fluid ejection dies 100*a*-100*c*.

Figure 8:
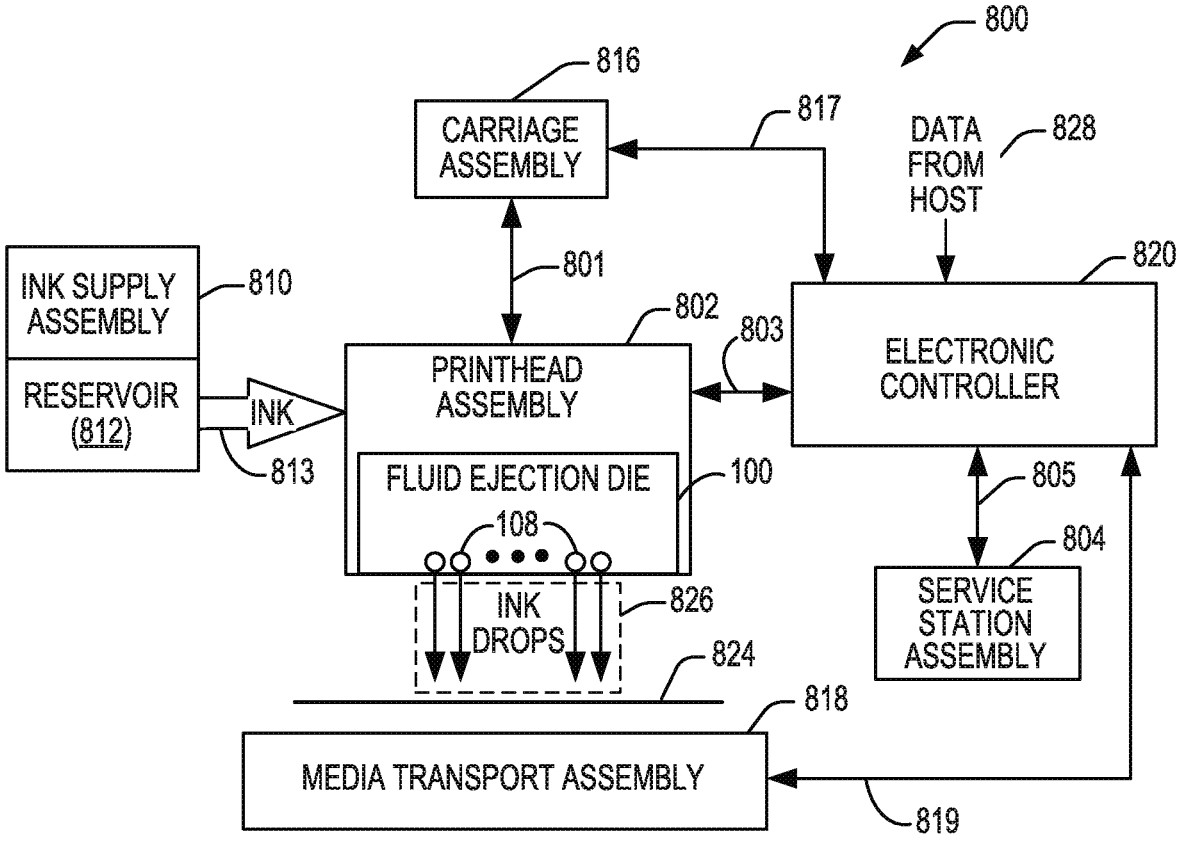
FIG. 8 is a block diagram illustrating one example of a fluid ejection system.

FIG. 8 is a block diagram illustrating one example of a fluid ejection system 800. Fluid ejection system 800 includes a fluid ejection assembly, such as printhead assembly 802, and a fluid supply assembly, such as ink supply assembly 810. In one example, printhead assembly 802 may include a fluid ejection device 200 of FIG. 2 or a fluid ejection device 300 of FIG. 3. In the illustrated example, fluid ejection system 800 also includes a service station assembly 804, a carriage assembly 816, a print media transport assembly 818, and an electronic controller 820. While the following description provides examples of systems and assemblies for fluid handling with regard to ink, the disclosed systems and assemblies are also applicable to the handling of fluids other than ink.

Printhead assembly 802 includes at least one printhead or fluid ejection die 100 previously described and illustrated with reference to FIGS. 1A and 1B, which ejects drops of ink or fluid through a plurality of orifices or nozzles 108. In one example, the drops are directed toward a medium, such as print media 824, so as to print onto print media 824. In one example, print media 824 includes any type of suitable sheet material, such as paper, card stock, transparencies, Mylar, fabric, and the like. In another example, print media 824 includes media for three-dimensional (3D) printing, such as a powder bed, or media for bioprinting and/or drug discovery testing, such as a reservoir or container. In one example, nozzles 108 are arranged in at least one column or array such that properly sequenced ejection of ink from nozzles 108 causes characters, symbols, and/or other graphics or images to be printed upon print media 824 as printhead assembly 802 and print media 824 are moved relative to each other.

Ink supply assembly 810 supplies ink to printhead assembly 802 and includes a reservoir 812 for storing ink. As such, in one example, ink flows from reservoir 812 to printhead assembly 802. In one example, printhead assembly 802 and ink supply assembly 810 are housed together in an inkjet or fluid-jet print cartridge or pen. In another example, ink supply assembly 810 is separate from printhead assembly 802 and supplies ink to printhead assembly 802 through an interface connection 813, such as a supply tube and/or valve.

Carriage assembly 816 positions printhead assembly 802 relative to print media transport assembly 818, and print media transport assembly 818 positions print media 824 relative to printhead assembly 802. Thus, a print zone 826 is defined adjacent to nozzles 108 in an area between printhead assembly 802 and print media 824. In one example, printhead assembly 802 is a scanning type printhead assembly such that carriage assembly 816 moves printhead assembly 802 relative to print media transport assembly 818. In another example, printhead assembly 802 is a non-scanning type printhead assembly such that carriage assembly 816 fixes printhead assembly 802 at a prescribed position relative to print media transport assembly 818.

Service station assembly 804 provides for spitting, wiping, capping, and/or priming of printhead assembly 802 to maintain the functionality of printhead assembly 802 and, more specifically, nozzles 108. For example, service station assembly 804 may include a rubber blade or wiper which is periodically passed over printhead assembly 802 to wipe and clean nozzles 108 of excess ink. In addition, service station assembly 804 may include a cap that covers printhead assembly 802 to protect nozzles 108 from drying out during periods of non-use. In addition, service station assembly 804 may include a spittoon into which printhead assembly 802 ejects ink during spits to ensure that reservoir 812 maintains an appropriate level of pressure and fluidity, and to ensure that nozzles 108 do not clog or weep. Functions of service station assembly 804 may include relative motion between service station assembly 804 and printhead assembly 802.

Electronic controller 820 communicates with printhead assembly 802 through a communication path 803, service station assembly 804 through a communication path 805, carriage assembly 816 through a communication path 817, and print media transport assembly 818 through a communication path 819. In one example, when printhead assembly 802 is mounted in carriage assembly 816, electronic controller 820 and printhead assembly 802 may communicate via carriage assembly 816 through a communication path 801. Electronic controller 820 may also communicate with ink supply assembly 810 such that, in one implementation, a new (or used) ink supply may be detected.

Electronic controller 820 receives data 828 from a host system, such as a computer, and may include memory for temporarily storing data 828. Data 828 may be sent to fluid ejection system 800 along an electronic, infrared, optical or other information transfer path. Data 828 represent, for example, a document and/or file to be printed. As such, data 828 form a print job for fluid ejection system 800 and includes at least one print job command and/or command parameter.

In one example, electronic controller 820 provides control of printhead assembly 802 including timing control for ejection of ink drops from nozzles 108. As such, electronic controller 820 defines a pattern of ejected ink drops which form characters, symbols, and/or other graphics or images on print media 824. Timing control and, therefore, the pattern of ejected ink drops, is determined by the print job commands and/or command parameters. In one example, logic and drive circuitry forming a portion of electronic controller 820 is located on printhead assembly 802. In another example, logic and drive circuitry forming a portion of electronic controller 820 is located off printhead assembly 802.

One example of the present disclosure is directed to a device, which includes a plurality of fluid ejection dies, wherein each of the fluid ejection dies includes a contact pad and a plurality of fluid actuation devices. The device includes an electrical interconnect element in contact with the contact pad of each of the fluid ejection dies to electrically interconnect the plurality of fluid ejection dies.

The device may further include a flex circuit connected to the electrical interconnect element and to electrical interconnect pads to connect to a host controller. The electrical interconnect element may be implemented in a flex circuit that includes a window at least partially surrounding the plurality of fluid ejection dies, and the electrical interconnect element may extend across the window. The electrical interconnect element may include a structure that is more rigid than the flex circuit. The electrical interconnect element may include a beam. The electrical interconnect element may include a targeting fiducial to facilitate alignment of the electrical interconnect element with the contact pads of the fluid ejection dies. Each of the fluid ejection dies may include a data contact pad for data transfer, and the electrical interconnect element may be in contact with the data contact pad. The device may further include a plurality of electrical interconnect elements. Each of the electrical interconnect elements may be in contact with the data contact pad of one of the fluid ejection dies. At least one of the electrical interconnect elements may extend across all of the fluid ejection dies of the device. At least one of the electrical interconnect elements may include a u-shaped element with two vertical portions and a horizontal portion, and wherein the horizontal portion is in contact with the data contact pad of one of the fluid ejection dies. Each of the fluid ejection dies may include a plurality of contact pads, and the device may further include a plurality of electrical interconnect elements, wherein each of the electrical interconnect elements extends across all of the fluid ejection dies and is in contact with one of the contact pads of each of the fluid ejection dies. The plurality of contact pads of each of the fluid ejection dies may be arranged in a column, and the plurality of electrical interconnect elements may be positioned perpendicularly to the column of contact pads in each of the fluid ejection dies. The plurality of fluid ejection dies may include at least three fluid ejection dies.

Another example of the present disclosure is directed to a device, which includes a carrier including a window. The device includes a fluid ejection die attached to the carrier and positioned within the window, wherein the fluid ejection die includes a contact pad and a plurality of fluid actuation devices. The device includes an electrical interconnect element that extends across the window and is in contact with the contact pad of the fluid ejection die.

The carrier may be a flex circuit. The device may include a plurality of fluid ejection dies attached to the carrier and positioned within the window, and each of the fluid ejection dies may include a contact pad and a plurality of fluid actuation devices, and the electrical interconnect element may be in contact with the contact pad of each of the fluid ejection dies. Each of the fluid ejection dies may include a data contact pad for data transfer, and the device may further include a plurality of electrical interconnect elements, wherein each of the electrical interconnect elements is in contact with the data contact pad of one of the fluid ejection dies, and wherein at least one of the electrical interconnect elements extends across the window.

Yet another example of the present disclosure is directed to a fluid ejection device, which includes a carrier including a plurality of electrical interconnect elements. The fluid ejection device includes at least three fluid ejection dies attached to the carrier. Each of the fluid ejection dies includes a plurality of contact pads and a plurality of fluid actuation devices. Each of the electrical interconnect elements is in contact with one of the contact pads of each of the fluid ejection dies. Each of the fluid ejection dies may comprise a single color fluid ejection die, and each single color fluid ejection die may be of a different color.

Although specific examples have been illustrated and described herein, a variety of alternate and/or equivalent implementations may be substituted for the specific examples shown and described without departing from the scope of the present disclosure. This application is intended to cover any adaptations or variations of the specific examples discussed herein. Therefore, it is intended that this disclosure be limited only by the claims and the equivalents thereof.

The invention claimed is:

1. A device, comprising:

at least three fluid ejection dies, wherein each of the fluid ejection dies includes a plurality of contact pads and a plurality of fluid actuation devices, wherein the plurality of contact pads of each of the fluid ejection dies is arranged in a column; and at least one electrical interconnect element that is positioned entirely perpendicularly to the column of contact pads in each of the at least three fluid ejection dies and that extends across at least a portion of a top surface of each of the at least three fluid ejection dies wherein the at least one electrical interconnect element is in direct contact with one of the contact pads of each of the at least three fluid ejection dies to electrically interconnect the at least three fluid ejection dies.

2. The device of claim 1, and further comprising a flex circuit connected to the at least one electrical interconnect element and to electrical interconnect pads to connect to a host controller.

3. The device of claim 2, wherein the at least one electrical interconnect element includes a structure that is more rigid than the flex circuit.

4. The device of claim 2, wherein at least one of the electrical interconnect elements functions as a ground or power and connects to two contact pads adjacent opposite longitudinal ends of at least one die, whereby the two contact pads are connected through an interconnect line of the flex circuit that extends along and next to the fluid ejection dies.

5. The device of claim 1, wherein the at least one electrical interconnect element includes a targeting fiducial to facilitate alignment of the at least one electrical interconnect element with the contact pads of the fluid ejection dies.

6. The device of claim 1, wherein each of the fluid ejection dies includes a data contact pad for data transfer, and wherein the at least one electrical interconnect element is in contact with the data contact pad.

7. The device of claim 1, comprising:

a plurality of electrical interconnect elements.

8. The device of claim 7, wherein each of the electrical interconnect elements in the plurality of electrical interconnect elements is in contact with a data contact pad of one of the fluid ejection dies.

9. The device of claim 7, wherein each of the electrical interconnect elements in the plurality of electrical interconnect elements includes at least one element that is in contact with one of the contact pads of each of the fluid ejection dies to electrically interconnect the at least three fluid ejection dies.

10. The device of claim 7, wherein at least one of the electrical interconnect elements in the plurality of electrical interconnect elements includes a u-shaped element with two vertical portions and a horizontal portion, and wherein the horizontal portion is in contact with a data contact pad of one of the fluid ejection dies.

11. A device, comprising:

a carrier including a window;

at least three fluid ejection dies positioned within the window, wherein each of the fluid ejection dies includes a column of contact pads and a plurality of fluid actuation devices; and a plurality of electrical interconnect elements of which each electrical interconnect element is positioned entirely perpendicularly to the column of contact pads of each of the at least three fluid ejection dies and is in contact with a contact pad of each of the fluid ejection dies to interconnect the contact pads.

12. The device of claim 11, wherein the device includes a flex circuit comprising interconnect wires and wherein an electrical interconnect element connects contact pads of multiple fluid ejection dies to a single interconnect wire.

13. The device of claim 12, wherein at least one of the electrical interconnect elements functions as a ground and connects to two contact pads adjacent opposite longitudinal ends of at least one of the dies through an interconnect wire of the flex circuit that extends next to and along the dies.

14. The device of claim 13, wherein the flex circuit comprises:

interconnect pads for connection to a fluid ejection system;

electrical interconnect wires along a length of the flex circuit; and electrical interconnect elements to connect contact pads of the dies to the interconnect pads via the electrical interconnect wires.

15. The device of claim 11, wherein each of the fluid ejection dies includes a contact pad for signal transfer, and wherein the device further comprises:

a plurality of electrical interconnect elements, wherein each of the electrical interconnect elements in the plurality of electrical interconnect elements is in contact with the contact pad for signal transfer of one of the fluid ejection dies.

16. A fluid ejection cartridge, comprising:

a plurality of fluid ejection dies attached to a common substrate, wherein each of the fluid ejection dies includes a plurality of contact pads and a plurality of fluid actuation devices, wherein the plurality of contact pads and fluid actuation devices of each of the fluid ejection dies are arranged in columns along a length direction of each die; and a plurality of electrical interconnect elements, wherein each electrical interconnect elements is positioned perpendicularly to the columns of contact pads and extends at least partially across a top surface of each fluid ejection die, in direct contact with a respective contact pads of each fluid ejection die, each electrical interconnect element to connect contact pads of the plurality of fluid ejection dies to a single common routing of a flex circuit that in turn is connected to a corresponding single interconnect pad to connect said contact pads to a fluid ejection system.

17. The fluid ejection cartridge of claim 16, wherein each of the fluid ejection dies comprises a single color fluid ejection die, and each single color fluid ejection die is of a different color.

18. The fluid ejection cartridge of claim 16, wherein at least one electrical interconnect element functions as a ground or power and connects to two contact pads adjacent opposite longitudinal ends of at least one die, whereby those contact pads are connected through an interconnect line of the flex circuit that extends along and next to the dies.

19. The fluid ejection cartridge of claim 16, wherein at least one of the electrical interconnect elements functions as a ground and connects to two contact pads adjacent opposite longitudinal ends of at least one die through an interconnect wire of the flex circuit that extends next to and along the dies.

20. The fluid ejection cartridge of claim 16, wherein the flex circuit comprises:

interconnect pads for connection to a fluid ejection system;

electrical interconnect wires along the length of the flex circuit; and electrical interconnect elements to connect contact pads of the dies to the interconnect pads via the electrical interconnect wires.

21. The fluid ejection cartridge of claim 16, and further comprising a plurality of said single common routings and a plurality of single interconnect pads, each single common routing connected to a corresponding single interconnect pad and corresponding electrical interconnect element.

* * * * *